US007280027B2

(12) United States Patent
Feth et al.

(10) Patent No.: US 7,280,027 B2
(45) Date of Patent: Oct. 9, 2007

(54) TOROIDAL CORE AND METHOD FOR PRODUCING THE SAME

(75) Inventors: Josef Feth, Heidenheim (DE); Jürgen Stabenow, Heidenheim (DE); Günter Feist, Gingen/Fils (DE)

(73) Assignee: EPCOS AG, Munich (DE)

( * ) Notice: Subject to any disclaimer, the term of this patent is extended or adjusted under 35 U.S.C. 154(b) by 217 days.

(21) Appl. No.: 10/545,362

(22) PCT Filed: Feb. 3, 2004

(86) PCT No.: PCT/DE2004/000171

§ 371 (c)(1),
(2), (4) Date: Aug. 11, 2005

(87) PCT Pub. No.: WO2004/077459

PCT Pub. Date: Sep. 10, 2004

(65) Prior Publication Data

US 2006/0192649 A1 Aug. 31, 2006

(30) Foreign Application Priority Data

Feb. 25, 2003 (DE) ..... 103 08 010

(51) Int. Cl.
*H01F 27/28* (2006.01)

(52) U.S. Cl. ..... 336/229; 336/206

(58) Field of Classification Search ..... 336/229, 336/206, 222

See application file for complete search history.

(56) References Cited

FOREIGN PATENT DOCUMENTS

| | | | |
|---|---|---|---|
| DE | 3047603 | | 7/1982 |
| DE | 8620742 | | 2/1988 |
| DE | 19604480 | | 8/1997 |
| DE | 19932475 | | 2/2001 |
| EP | 0258592 | | 3/1988 |
| JP | 09045539 A | * | 2/1997 |
| JP | 09237717 A | * | 9/1997 |

* cited by examiner

*Primary Examiner*—Anh Mai
(74) *Attorney, Agent, or Firm*—Fish & Richardson P.C.

(57) ABSTRACT

An insulating device includes two or more webs extending radially outwards and a plurality of elastic tongues connected to an end of at least one of the two or more webs. At least one of the two or more webs has an elastically deformable spring element. The insulating device is configured to fit into a core hole of a toroidal core.

16 Claims, 2 Drawing Sheets

TOROIDAL CORE AND METHOD FOR PRODUCING THE SAME

TECHNICAL FIELD

The invention relates to an insulating part to be fitted into the internal space of a toroidal core. The invention also relates to a toroidal core with an insulating part. In addition, the invention relates to a toroidal core choke. Furthermore, the invention relates to a method for the production of a toroidal core choke.

BACKGROUND

In order to produce multiple chokes, several windings insulated from one another are wound onto toroidal cores along a periphery. In order to ensure the electrical insulation between the windings, one or more electrical isolations are provided in the interior space of the toroidal core. The winding space located in the interior of the toroidal core is thus preferably divided into several winding spaces of equal size.

Since the toroidal cores are resintered during production with an insulation, the resintered cores exhibit relatively marked deviations from one another in respect of their inner diameter. An electrical isolation is intended to compensate for these tolerances as far as possible.

It is known to place the toroidal core onto a holding device with injection moulded insulating webs. This has the drawback that the electrical isolation cannot be fitted until after the winding-on. In the case of chokes with a high number of windings, which have to be arranged in two or even more layers on the toroidal core, no space or only very little space thus remains for the subsequent fitting of the injection moulded insulating webs.

Furthermore, it is known to insert two pressboards into one another and then to install the same in the toroidal core. This has the drawback that the boards can be slightly displaced by the winding tension during winding-on. The effect of this would be that the winding spaces would diverge from one another in their size. As a result, it would not be possible to arrange several windings of equal size on the choke making optimum use of the available space.

According to another known technique for producing the electrical isolation, several plastic boards are clamped against one another in the core hole, i.e. in the interior of the toroidal core. This has the drawback that the arrangement of plastic boards only becomes properly stable after the fitting of the last board. Moreover, this has the drawback that a relatively high outlay is required for the fitting.

It is further known to use toroidal cores in plastic troughs or cores injection-coated with plastic with moulded grooves for receiving rigid plastic insulating webs or plastic insulating crosses. The tolerances of the core inner diameter are compensated for by the plastic shell. Such an arrangement has the drawback that valuable winding space is lost on account of the plastic sheathing. Furthermore, there is the drawback that the sheathing is cost-intensive in production due to its complex geometrical shape.

SUMMARY

The problem of the present invention, therefore, is to provide an insulating part for a toroidal core, said insulating part being able to be easily fitted and capable of compensating for tolerances of the core hole diameters.

This problem is solved by an insulating part according to claim 1. Advantageous embodiments of the insulating part, a toroidal core for a toroidal core choke, a toroidal core choke and a method for carrying out the winding of a toroidal core are specified in the further claims.

An insulating part to be fitted into the core hole of a toroidal core is specified, which insulating part contains a number $n \geqq 2$ of webs running radially outwards. At least one web has an elastically deformable spring element.

The insulating part has the advantage that, as a result of the spring element preferably deformable by a radial force, it can be adapted to various core hole diameters of toroidal cores. Moreover, the insulating part has the advantage that, as a result of its simple structure, it can be produced in a simple and low-cost manner, for example by means of injection moulding.

In an embodiment of the insulating part, elastic tongues are arranged at the outer end of a web. These elastic tongues then at least partially assume the function of the deformable spring elements. For one or more webs, they can for example be arranged in pairs at the outer ends of said webs and each run diverge from the radial direction, respectively.

In another embodiment of the insulating part, neighbouring webs are joined together by means of elastic carrier elements.

These carrier elements can at the same time be used for the insulating division of the core hole into winding spaces. They form an inner boundary, said boundary being for example complementary to the section of the toroidal core arranged between two webs.

In another embodiment of the insulating part, the webs are offset with respect to one another essentially by an angle of 360°/n. It thus becomes possible in a straightforward and advantageous way to divide the core hole into winding spaces of equal size.

In another embodiment of the insulating part, the latter has an n-gonal axis of symmetry. This is understood to mean that the insulating part is mapped onto itself when rotated through by an angle of 360°/n about the axis of symmetry. Such a symmetry has the advantage that production can be greatly facilitated, since the diversity of shape that has to be taken into account is as small as possible.

In another embodiment, the insulating part is designed in one piece. To advantage, it can thus be produced for example by means of an injection-moulding technique.

In another embodiment of the insulating part, the latter can contain a thermoplastic, e.g. polycarbonate. The material polycarbonate has the advantage that, on the one hand, it is a very good electrical insulator and, on the other hand, has very good fire behaviour, i.e. an only very low inflammability according to standard UL 94 V-0.

The materials Lexan or Macrolon, for example, come into consideration as a polycarbonate.

Furthermore, a toroidal core is specified which contains in its core hole one of the insulating parts just described. Such a toroidal core has the advantage that it can be used to very good advantage for the production of a toroidal core choke. Such a production process is indicated in the following:

Use is made of a toroidal core, in whose core hole an insulating part is arranged. The insulating part is designed in such a way that it projects beyond the toroidal core in the axial direction. The insulating part can project beyond the toroidal core on the upper side and on the lower side or only on one side. During the winding of the toroidal core, the latter is held on the insulating part. This procedure has the advantage that the mechanically very delicate and, for example, resintered toroidal core is not subject to a mechanical strain caused by a holding device during the winding.

Furthermore, a toroidal core choke is also specified, which contains a toroidal core as just described. In addition, each section of the toroidal core lying between two webs is wound with a winding.

By means of such a toroidal core choke, it is possible in a straightforward manner to produce a multiple choke with several windings insulated against one another, which in addition contain the same number of windings.

The invention is explained in greater detail below with the aid of examples of embodiment and the respective figures.

DESCRIPTION OF THE DRAWINGS

It is pointed out that elements designated by the same reference numbers are the same as one another or are the same at least with regard to their function.

DETAILED DESCRIPTION

Figure 1:
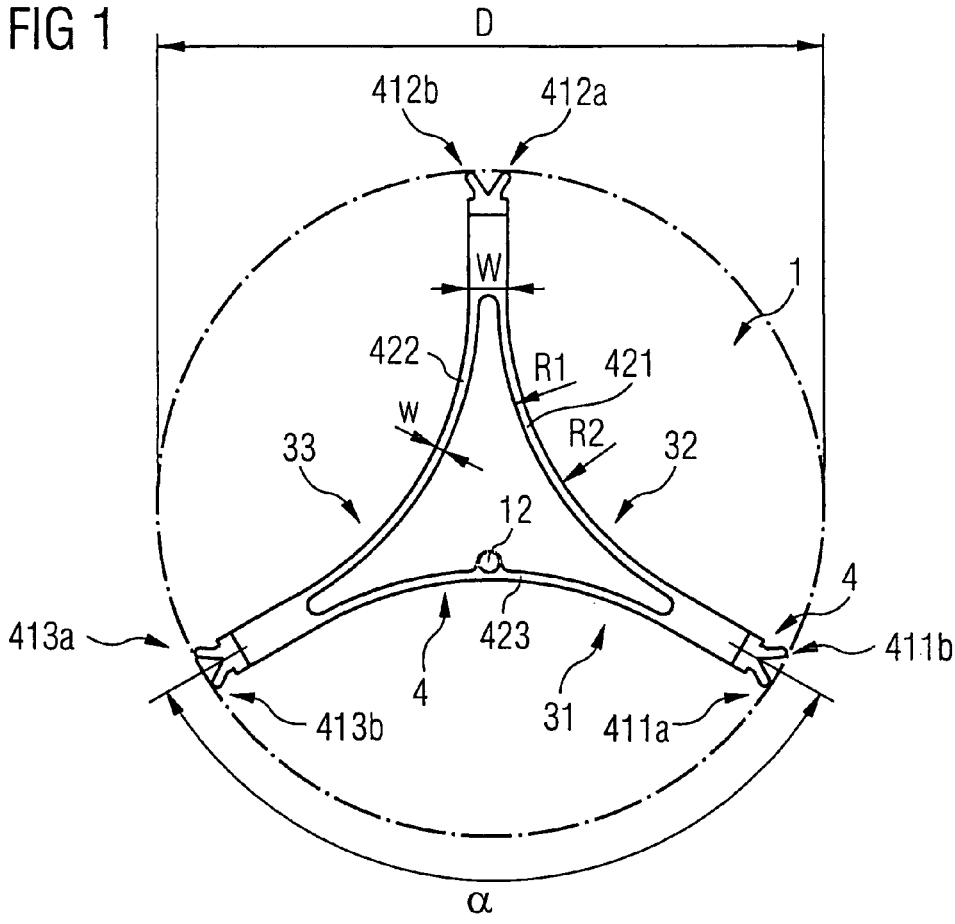
FIG. 1 shows an exemplary insulating part in a plan view.

FIG. 1 shows an insulating part 1 in plan view. It has webs 31, 32, 33, which are connected together by carrier elements (421, 422, 423). Webs 31, 32, 33 run in the radial direction from an imaginary centre-point of the insulating part. Axis of symmetry 5 runs through the imaginary centre-point of insulating part 1 (see FIG. 2).

Carrier elements 421, 422, 423 are designed very thin-walled and have a relatively large outer and inner radius of curvature R1, R2. Inner radius of curvature of R1 can amount for example to 16.5 mm and outer radius of curvature R2 to 16 mm. A wall thickness of the carrier elements of 0.5 mm results therefrom. Such carrier elements 421, 422, 423 are characterised by a high elasticity, which means that they can be deformed in the radial direction by pressing webs 31, 32, 33, which are stiff compared to the carrier elements, and thus demonstrate the adaptability of the insulating part to different core hole diameters.

Webs 31, 32, 33 have a wall thickness W of 2 mm. Carrier elements 421, 422, 423 have a wall thickness w of 0.5 mm.

Tongues 411*a*, 411*b*; 412*a*, 412*b* and 413*a*, 413*b* are arranged in each case in pairs at the outer ends of webs 31, 32, 33, respectively. These tongues extend in a direction diverging from the radial direction and are designed with regard to their wall thickness in such a way that they are similar to the wall thickness of carrier elements 421, 422, 423. Tongues 411*a*, 411*b*, 412*a*, 412*b*, 413*a*, 413*b* also perform here the function of spring elements 4. By exerting a pressure in the radial direction, the tongues and the carrier elements of the insulating part can be bent to the side, and an adaptation of the insulating part to smaller core hole diameters can take place.

Insulating part 1 has in its centre a roughly triangular hollow space running in a straight line over the whole height (see FIG. 2), as a result of which insulating part 1 can be produced very simply in an injection moulding technique. Due to carrier elements 421, 422, 423, which in each case connect two webs 31, 32, 33 to one another respectively, the insulating part also exhibits high mechanical stability, which makes it possible to insert the insulating part as a one-piece element, even before the winding of the toroidal core has been carried out, into the core hole of the latter.

In the case of three webs 31, 32, 33, the latter are offset with respect to one another by an angle $\alpha$ of 120°.

It should however be noted that the present invention is not restricted to three webs. On the contrary, consideration can be given to using, instead of three, also two or four or five or a greater whole number, in order to subdivide the core hole of the toroidal core into winding spaces of equal size or simply into a plurality of winding spaces.

It is also indicated in FIG. 1 that the insulating part extends radially to an extent such that it can be circumscribed by a circle with diameter D of 32.4 mm.

The centre-point of the circumscribing circle forms at the same time the centre-point of the insulating part, and this should be borne in mind in each case with the term "radial".

As a result of spring elements 4 co-operating with the rigid webs, said spring elements being contained in the insulating part according to FIG. 1, the insulating part can be fixed mechanically very rigidly in the core hole of a toroidal core, and this has the advantage that the webs of insulating part 1 cannot be pushed away during the winding.

For the purposes of production by means of an injection moulding technique, a pressing face 12 is also provided, by means of which insulating part 1 can be pressed out of the injection-moulding mould.

Figure 2:
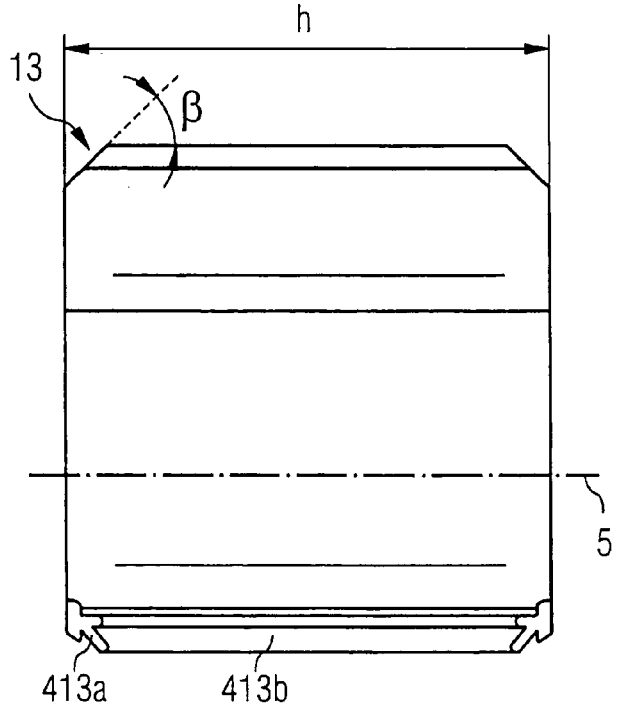
FIG. 2 shows the insulating part from FIG. 1 in a side view.

FIG. 2 shows a side view of insulating part 1 from FIG. 1, from which height h of 24 mm emerges. In addition, FIG. 2 shows an axis of symmetry 5, which runs through the centre of the insulating part 1, shown in FIG. 1 as the centre-point of the outer circle. It further emerges from FIG. 2 that slants 13 can be provided at the sides at the upper side and at the lower side of insulating part 1, with which the outer edges of said slants being inclined at an angle $\beta$ with respect to the axis of symmetry 5. The angle $\beta$ can for example amount to 45°. Slants 13 facilitate the introduction of the insulating part into the core hole of a toroidal core, since automatic self-centring can thus be achieved.

Figure 3:
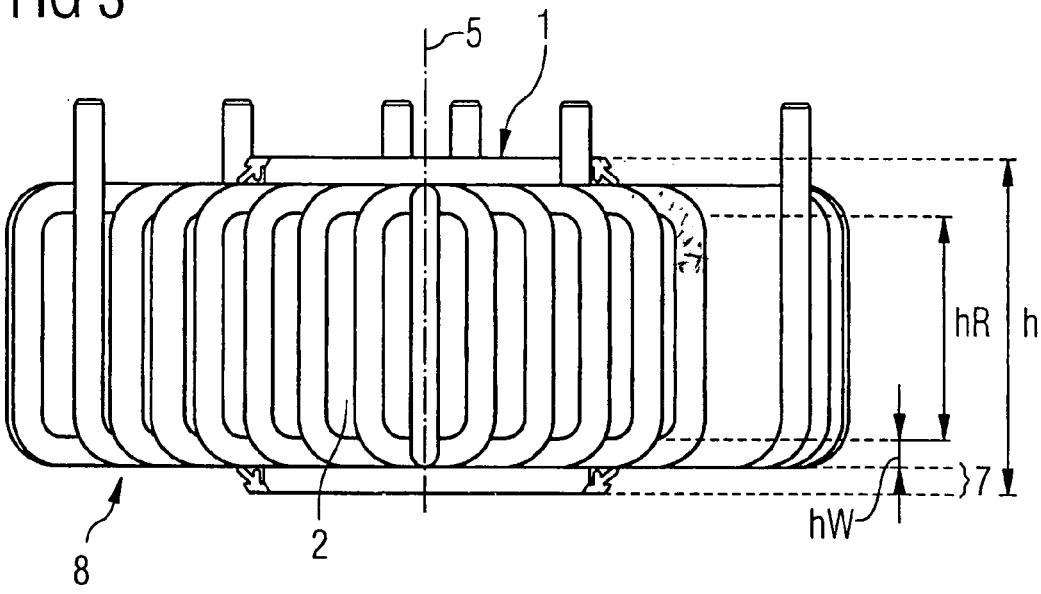
FIG. 3 shows an exemplary toroidal core choke containing an insulating part according to FIG. 1 in a side view.

FIG. 3 shows a toroidal core choke in a side view. A toroidal core 2 is shown, onto which a winding 8 is wound. An insulating part 1 according to FIG. 1 is inserted into the core hole of toroidal core 2. Height h of insulating part 1, as well as height hR of the toroidal core and height hW of winding 8 are selected such that a projection 7 of insulating part 1 results on both sides, i.e. on the upper side and on the lower side of toroidal core 2. This projection 7 can be present on one or both sides of the toroidal core. It is used to hold toroidal core 2 during the winding of windings 8.

Figure 4:
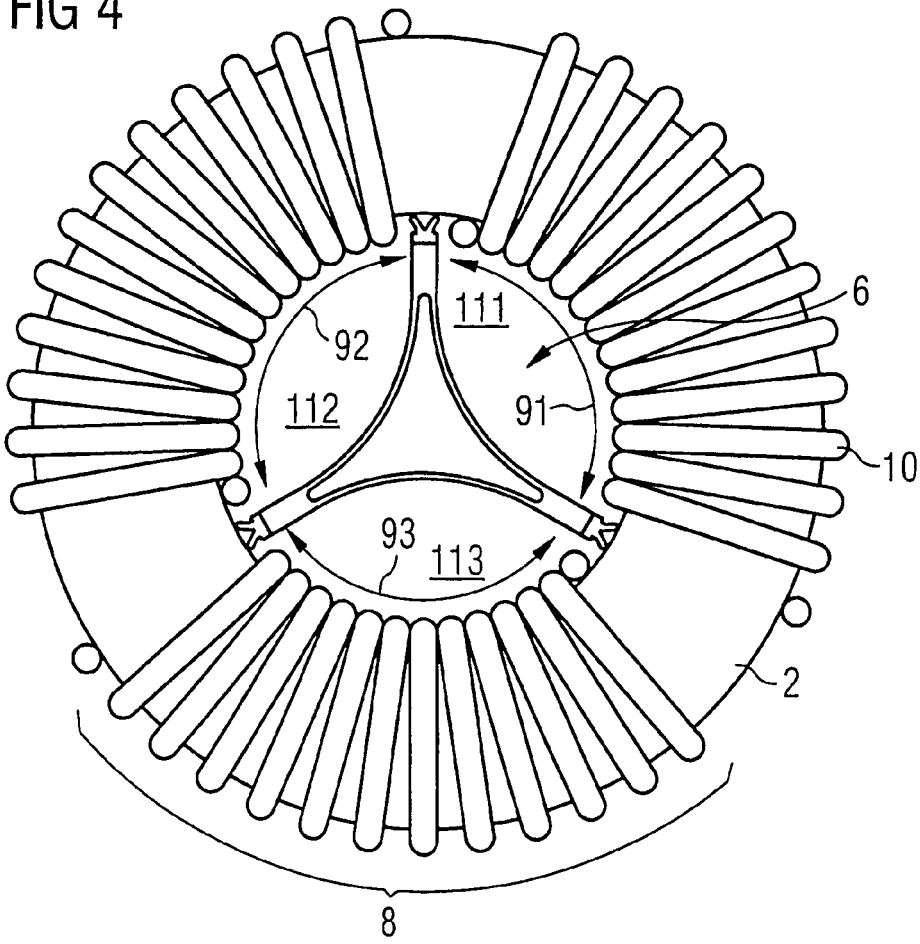
FIG. 4 shows the toroidal core choke from FIG. 3 in a plan view.

FIG. 4 shows a plan view of the toroidal core choke from FIG. 3. It can be seen that core hole 6 is divided by insulating part 1 into three winding spaces 111, 112, 113 of equal size. Each section 91, 92, 93, of toroidal core 2 lying between two webs is wound with a wire 10, as a result of which three windings 8 well insulated from one another have emerged.

It is pointed out that the present invention is not restricted to the examples of embodiment presented here. On the contrary, it is conceivable that, instead of three, fewer or more webs can also be used for dividing the core hole into winding spaces. Furthermore, the design of the spring elements is not restricted to carrier elements or tongues. On the contrary, all possible suitable devices come into consideration, in order to achieve a spring-mounting of the preferably rigid webs in the radial direction.

The invention claimed is:

1. An insulating device adaptable to fit into a core hole of a toroidal core, the insulating device comprising:

webs extending radially outwards, at least one web comprising an elastically deformable spring element; and a plurality of elastic tongues connected to an end of the at least one web.

2. The insulating device of claim 1, further comprising a plurality of elastic carrier elements, wherein a first web and a second web are connected by the plurality of elastic carrier elements.

3. The insulating device of claim 1, wherein the webs are offset with respect to one another by an angle ($\alpha$) of about 360°/n.

4. The insulating device of claim 1, wherein the webs have an n-gonal axis of symmetry.

5. The insulating device of claims 1, wherein the webs and the plurality of elastic tongues comprise a single piece.

6. The insulating device of claim 1, wherein the insulating device comprises an injection-molded part.

7. The insulating device of claim 1, wherein the insulating device comprises a thermoplastic material.

8. A toroidal core comprising an insulating device according to claim 1, wherein the insulating device is disposed in the core hole of the toroidal core.

9. A method for winding a toroidal core, the method comprising:

holding an insulating part during winding, the insulating part including:

webs extending radially outwards, at least one web comprising an elastically deformable spring element; and a plurality of elastic tongues connected to an end of the at least one web.

10. A toroidal core choke, comprising:

a toroidal core according to claim 8, wherein each section of the toroidal core is disposed between two webs, each section being wound with a winding.

11. The method of claim 10, wherein the insulating part further comprises a plurality of elastic carrier elements, wherein a first web and a second web are connected by the plurality of elastic carrier elements.

12. The method of claim 10, wherein the webs are offset with respect to one another by an angle ($\alpha$) of about 360°/n.

13. The method of claim 10, wherein the webs have an n-gonal axis of symmetry.

14. The method of claim 10, wherein the webs and the plurality of elastic tongues comprise a single piece.

15. The method of claim 10, wherein the insulating part comprises an injection-molded part.

16. The method of claim 10, wherein the insulating part comprises a thermoplastic material.

* * * * *